US006414425B1

(12) United States Patent
Yokota et al.

(10) Patent No.: US 6,414,425 B1
(45) Date of Patent: Jul. 2, 2002

(54) CATHODE-RAY TUBE

(75) Inventors: Masahiro Yokota, Fukaya; Hiroaki Ibuki, Kumagaya, both of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/529,409

(22) PCT Filed: Aug. 31, 1999

(86) PCT No.: PCT/JP99/04717

§ 371 (c)(1),
(2), (4) Date: Apr. 27, 2000

(87) PCT Pub. No.: WO00/13199

PCT Pub. Date: Mar. 9, 2000

(30) Foreign Application Priority Data

Aug. 31, 1998 (JP) ..... 10-246202

(51) Int. Cl.[7] ..... H01J 29/10
(52) U.S. Cl. ..... 313/461; 313/477 R
(58) Field of Search ..... 313/461, 477 R

(56) References Cited

FOREIGN PATENT DOCUMENTS

| | | |
|---|---|---|
| JP | 6-44926 | 2/1994 |
| JP | 06-036710 A | 2/1994 |
| JP | 7-29566 | 7/1995 |
| JP | 245685 | 9/1997 |
| JP | 10-64451 | 3/1998 |
| JP | 11-135038 A | 5/1999 |
| JP | 11-144648 A | 5/1999 |

*Primary Examiner*—Vip Patel
(74) *Attorney, Agent, or Firm*—Oblon, Spivak, McClelland, Maier & Neustadt, P.C.

(57) ABSTRACT

A vacuum envelope for cathode-ray tube comprises a panel having a flat outer surface and a convex curved inner surface, and a substantially rectangular fluorescent screen (14) with an aspect ratio of M:N is formed in this inner surface. In the inner surface of the panel (12), the gaps ΔH(r), ΔV(r), and ΔD(r) from the center on the horizontal, vertical and diagonal axes of the fluorescent screen (14) are determined in a specific relationship. By forming a proper curved surface in the inner surface of a panel (12) whose outer surface is a flat surface, the strength of the vacuum envelope is maintained, deterioration of visual recognition of flatness is suppressed, and, in the color cathode ray tube, the workability of the shadow mask is further enhanced.

4 Claims, 4 Drawing Sheets

CATHODE-RAY TUBE

TECHNICAL FIELD

The present invention relates to a cathode-ray tube, and more particularly to a cathode-ray tube in which a flatness of image is improved in the effective region of panel to enhance the visual recognition, and a color selecting electrode (shadow mask) can be worked or shaped easily.

BACKGROUND ART

Generally, a cathode-ray tube has a vacuum envelope made of a glass panel having a substantially rectangular face plate and glass funnel. In this cathode-ray tube, the electron beam emitted from an electron gun arranged in the neck of the funnel is deflected by a deflection yoke provided on the funnel, the deflected electron beam is directed to a substantially rectangular fluorescent screen formed on an inner effective region of the face plate, and the screen is scanned by the electron beam horizontally and vertically so that an image is displayed on the screen. In a color cathode ray tube, in particular, the fluorescent screen formed on the effective region of the panel is composed of three color fluorescent layers emitting in blue, green and red light rays, and instead of the electron gun for generating a single electron beam, an electron gun structure or assembly for emitting three electron beams is provided in the neck of the funnel. The three electron beams emitted from the electron gun assembly are deflected by the deflection yoke, and so pass through the shadow mask as to be selectively directed to the corresponding fluorescent layers. The fluorescent screen is scanned horizontally and vertically by these electron beams so that a color image is displayed on the screen.

Such a cathode-ray tube is preferably designed to be flat in the effective region of the panel and the fluorescent screen from the viewpoint of ease of observing the image. There have been already attempted about flattening of the panel, but there are many problems in the conventional art that strength of the vacuum envelope made of glass is decreased, and, in the color cathode ray tube, the shadow mask can not be easily shaped into a flat structure and vibration may be occurred on the shaped shadow mask. Thus it is a contradictory problem to improve the flatness of the panel to enhance the visual recognition and the image characteristic and to maintain the mechanical characteristic of the panel and the shadow mask.

Jpn. Pat. Appln. KOKAI Publication No. 7-99030 discloses a color cathode ray tube having the flat inner and outer surfaces of the effective region of the panel. However, when the effective region of the panel is formed in a flat surface, in order to compensate for the strength of the vacuum envelope, even if the side wall of the panel is tightened by a conventional reinforcement band, the strength of the vacuum envelope is not assured. That is, in the conventional panel which is so formed as to have a convex surface projecting in the outward direction in the center of at least the inner surface of the effective region, the side wall is tightened by a reinforcement band so that the convex surface of the inner surface of the effective region can be held. Thus, it is possible to compensate for the distortion of sinking of the central part of the effective region which may be caused under the atmospheric pressure. However, in the panel having a flat surface in the inner surface of the effective region, since the central part sinks, the compensation action can not be obtained. In such a panel, accordingly, it is required to glue a safety panel or the like to the outer surface of the effective region, which results in added thickness or added cost of the panel. In particular, thickening of the panel deteriorates the visual recognition of flatness due to the floating phenomenon of image in the peripheral area of the screen by refraction of light rays in the panel glass as discussed later. Further, corresponding to the inner surface of the effective region of the panel, it is also necessary to flatten the effective surface of the shadow mask, but as compared with the curved shadow mask, the flattened shadow mask is inferior in workability, and the cost may be increased.

To solve the problem of floating phenomenon of image in the peripheral area due to refraction of light rays in the panel glass mentioned above, Jpn. Pat. Appln. KOKAI Publication No. 6-36710 discloses a cathode-ray tube having a constitution in which the effective region of the panel is formed in the concave lens structure to compensate for floating of image in the peripheral area of the screen.

However, in the panel curved in the inner surface of the effective region of the panel to such a limit as to apply the shadow mask having the effective surface formed in a curved surface, if such concave lens structure is applied, the thickness of the peripheral part of the effective region is too thick, and the transmittance in the peripheral area is degraded, and the visual recognition of the flatness relative to the viewpoint remote from the tube axis is increasingly decreased.

Jpn. Pat. Appln. KOKAI Publication No. 6-44926 discloses a cathode-ray tube having a safety panel glued through a transparent resin layer to the outer surface of a panel whose outer surface is substantially a flat surface and whose inner surface is a curved surface having a certain curvature in the horizontal and vertical direction.

In the cathode-ray tube having such structure, it is possible to compensate for the strength of the vacuum envelope. However, the transmittance is decreased in the peripheral area, and the problem of deterioration of visual recognition of flatness relative to the viewpoint remote from the tube axis can not be solved.

Further, Jpn. Pat. Appln. KOKAI Publication No. 9-245685 discloses a cylindrical cathode-ray tube whose outer surface is substantially a flat surface and whose inner surface is a curved surface in the horizontal direction, and Jpn. Pat. Appln. KOKAI Publication No. 10-64451 discloses a color cathode ray tube having a curved surface whose radius of curvature in the horizontal direction is infinite and radius of curvature in the vertical direction is fixed. In particular, Jpn. Pat. Appln. KOKAI Publication No. 10-64451 shows the color cathode ray tube whose wall thickness in the peripheral area of the effective region of the panel is about 1.2 to 1.3 times that of the central part in consideration of floating of image due to refraction of light rays by the panel glass. Actually, however, by the wall thickness difference of such degree, the strength of the vacuum envelope by the reinforcement band can not be obtained sufficiently, and it is a difficult problem to realize a cathode-ray tube suppressed in cost. These publications of cathode-ray tubes merely refer to the visual recognition of flatness in consideration of only the gap (distance in the tube axial direction) of the diagonal ends from the central part of the inner surface of the effective region of the panel, and nothing is considered about the visual recognition of flatness due to cylindrical shape of the inner surface of the effective region.

Incidentally, Jpn. UM (Utility Model). Publication No. 7-29566 discloses a cathode-ray tube, as shown in FIG. 7, for suppressing the distortion of image by forming a closed loop in the entire screen along a line 2 (equal thickness line) linking the points of equal wall thickness of the panel 1.

In such constitution, however, the horizontal axial end (X-axis end), vertical axial end (Y-axis end) and diagonal axial end (D-axis end) of the panel 1 are equal in wall thickness, and the effect of suppressing distortion by refraction of light rays in the panel 1 is lowered. Moreover, in the panel 1, peaks are formed near the diagonal axial ends, and when the viewpoint is moved, the peaks may be easily recognized visually. Further, in the case of the color cathode ray tube, when forming the effective surface of the shadow mask in a shape similar to the inner surface of the panel 1, the strength for holding the curved surface is weak in the marginal area of the equal thickness line, that is, in the flat region near the horizontal and vertical axial ends. It is hence regarded difficult to realize such color cathode ray tube.

Therefore, from the viewpoint of ease of seeing the image, the cathode-ray tube is desired to make the inner surface of the panel effective region and the fluorescent screen flat. However, when the inner surface of the panel effective region and the fluorescent screen are formed into flat, the strength of the vacuum envelope made of glass may not be sufficient. Still more, due to refractive index of the light rays in the panel glass, the floating phenomenon of image in the peripheral area of the screen may occur, and the visual recognition of the flatness may be impaired. In the color cathode ray tube, yet, the workability of the shadow mask may be decreased.

DISCLOSURE OF INVENTION

It is hence an object of the invention to provide a cathode-ray tube formed in a proper curved surface on the inner surface of a panel whose outer surface is a flat surface, capable of assuring the strength of the vacuum envelope, suppressing deterioration of visual recognition of flatness due to refraction of light rays in the panel glass, and, in a color cathode ray tube, further enhancing the workability of the color selecting electrode (shadow mask).

(1) In a cathode-ray tube having a panel whose outer surface is a flat surface and whose inner surface is a convex curved surface projecting in the outward direction from its center, and forming a substantially rectangular fluorescent screen on the inner surface of this panel, with an aspect ratio of M:N where M is the distance in the horizontal direction and N is the distance in the vertical direction, the inner surface of the panel is formed in a curved surface satisfying the following formulas $$\Delta D(r) > \Delta H\left(\frac{M}{\sqrt{M^2+N^2}}\cdot r\right) > \Delta D\left(\frac{M}{\sqrt{M^2+N^2}}\cdot r\right) \tag{10}$$

$$\Delta D(r) > \Delta V\left(\frac{N}{\sqrt{M^2+N^2}}\cdot r\right) > \Delta D\left(\frac{N}{\sqrt{M^2+N^2}}\cdot r\right) \tag{11}$$

where ΔH(r), ΔV(r), ΔD(r) are respectively gaps or difference along a tube axis on the horizontal axis, vertical axis and diagonal axis of the fluorescent screen at positions of distance r from the center of the inner surface.

(2) In the cathode-ray tube of (1), when the gap ΔD(r) on the diagonal axis of the fluorescent screen of the panel is the maximum gap ΔD(r Max), this gap ΔD(r Max) is determined in a range of 5 mm to 20 mm.

(3) In a cathode-ray tube having a panel whose outer surface is a flat surface and whose inner surface is a convex curved surface projecting in the outward direction from its center, forming a substantially rectangular fluorescent screen composed of fluorescent layers of plural colors on the inner surface of this panel, with an aspect ratio of M:N where M is the distance in the horizontal direction and N is the distance in the vertical direction, and disposing a substantially rectangular color selecting electrode faced to this fluorescent screen, having a convex curved surface projecting in the direction of the fluorescent screen from its center, with an aspect ratio of this convex curved surface of M:N where M is the distance in the horizontal direction and N is the distance in the vertical direction, for selecting plural beams emitted from an electron gun by this color selecting electrode and displaying a color image on the fluorescent screen, the convex curved surface of the color selecting electrode is formed in a curved surface satisfying the following formulas $$\Delta DM(r) > \Delta HM\left(\frac{M}{\sqrt{M^2+N^2}}\cdot r\right) > \Delta DM\left(\frac{M}{\sqrt{M^2+N^2}}\cdot r\right) \tag{12}$$

$$\Delta DM(r) > \Delta VM\left(\frac{N}{\sqrt{M^2+N^2}}\cdot r\right) > \Delta DM\left(\frac{N}{\sqrt{M^2+N^2}}\cdot r\right) \tag{13}$$

where ΔHM(r), ΔVM(r), ΔDM(r) are respectively gaps on the horizontal axis, vertical axis and diagonal axis of the color selecting electrode at positions of distance r from the center of the convex curved surface.

(4) In the cathode-ray tube of (3), when the gap ΔDM(r) on the diagonal axis of the color selecting electrode is the maximum gap ΔDM(r Max), this maximum gap ΔDM(r Max) is determined in a range of 5 mm to 20 mm.

BEST MODE FOR CARRYING OUT THE INVENTION

Figure 1:
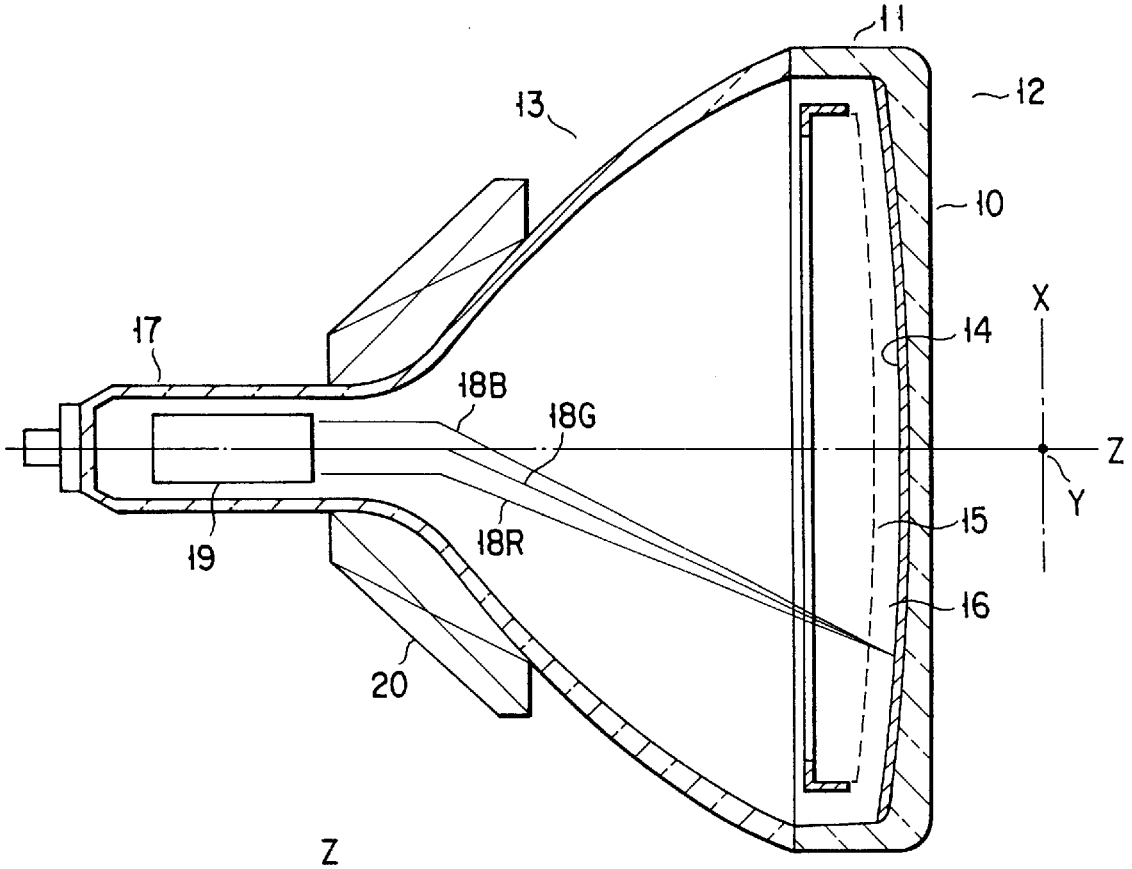
FIG. 1 is a sectional view schematically showing a structure of a color cathode ray tube according to an embodiment of the invention.

Referring now to the drawings preferred embodiments of the color cathode ray tube of the invention are described in detail below.

FIG. 1 shows a color cathode ray tube according to an embodiment of the invention. This color cathode ray tube has a vacuum envelope composed of a substantially rectangular panel 12 having a skirt 11 provided on the periphery of an effective region 10, and a conical funnel 13. A fluorescent screen 14 composed of three fluorescent layers emitting in blue, green and red colors is formed on the inner surface of the effective region 10 of the funnel 13, and at a specific distance from the fluorescent screen 14, there is a shadow mask 16 as a color selecting electrode having electron beam passing holes in an effective surface 15 facing the fluorescent screen 14 at its inner side. On the other hand, in a neck 17 of the funnel 13, there is an electron gun assembly 19 or emitting three electrons beams 18B, 18G, 18R. The three electron beams 18B, 18G, 18R emitted from this electron gun 19 are deflected by a deflection yoke 20 mounted at the outer side of the funnel 13, and pass through the shadow mask 16 to be directed toward the fluorescent screen 14, and when this fluorescent screen 14 is scanned horizontally and vertically by the electron beams 18B, 18G, 18R, a color image is displayed on the fluorescent screen 14.

The panel 12 has the effective region 10 with a flat outer surface, and the inner surface of this effective region 10 is formed in a convex curved surface projecting in the outward direction from its center. The fluorescent screen 14 is formed in a substantially rectangular shape with the aspect ratio of M:N where M is the length of the inner surface of this convex curved surface in the horizontal direction (X-axis direction) and N is the length in the vertical direction (Y-axis direction). The shadow mask 16 facing this fluorescent screen 14 has an effective surface 15 corresponding to the inner surface shape of the effective region 10 of the panel 12, and this effective surface 15 is formed in a convex curved surface projecting in the direction of the fluorescent screen 14 from its center, and it is formed in a substantially rectangular shape with an aspect ratio of M:N where M is the distance of this effective surface 15 in the horizontal direction and N is the distance in the vertical direction.

In this embodiment, the inner surface of the convex curved surface of the effective region 10 of the panel 12 is formed in a curved surface satisfying the following formulas $$\Delta D(r) > \Delta H\left(\frac{M}{\sqrt{M^2+N^2}}\cdot r\right) > \Delta D\left(\frac{M}{\sqrt{M^2+N^2}}\cdot r\right) \tag{14}$$

$$\Delta D(r) > \Delta V\left(\frac{N}{\sqrt{M^2+N^2}}\cdot r\right) > \Delta D\left(\frac{N}{\sqrt{M^2+N^2}}\cdot r\right) \tag{15}$$

where ΔH(r), ΔV(r), ΔD(r) are gaps or drops (the distance on difference along the tube axis Z between the center and the position at distance r from the center) on the horizontal axis, vertical axis and diagonal axis of the fluorescent screen 14 at positions of distance r from the center of the inner surface, respectively. Moreover, when the gap ΔD(r) on the diagonal axial end of the fluorescent screen 14 is the maximum gap ΔD(r Max), this maximum gap ΔD(r Max) is determined in a range of 5 mm to 20 mm.

The effective surface 15 of the convex curved surface of the shadow mask 15 is formed in a curved surface satisfying the following formulas $$\Delta DM(r) > \Delta HM\left(\frac{M}{\sqrt{M^2+N^2}}\cdot r\right) > \Delta DM\left(\frac{M}{\sqrt{M^2+N^2}}\cdot r\right) \tag{16}$$

$$\Delta DM(r) > \Delta VM\left(\frac{N}{\sqrt{M^2+N^2}}\cdot r\right) > \Delta DM\left(\frac{N}{\sqrt{M^2+N^2}}\cdot r\right) \tag{17}$$

where ΔHM(r), ΔVM(r), ΔDM(r) are gaps or drops (the distance or difference along the tube axis Z between the center and the position at distance r from the center) on the horizontal axis, vertical axis and diagonal axis at positions of distance r from the center of the effective surface 15, respectively. Moreover, when the gap ΔDM(r) on the diagonal axis of the effective surface 15 is the maximum gap ΔDM(r Max), this maximum gap ΔDM(r Max) is determined in a range of 5 mm to 20 mm.

When the panel 12 and shadow mask 16 have such curved surfaces, the visual recognition of flatness of the image displayed on the fluorescent screen 14 is improved, and moreover the strength of the vacuum envelope and the workability of the shadow mask 16 are enhanced, so that a sufficient strength may be obtained.

The following is the explanation of the reason why it is preferred that the panel 12 and shadow mask 16 have such curved surfaces.

Generally, the visual recognition of flatness of image depends on the distortion of reflected image and distortion of image formed on the fluorescent screen. The reflected image consists of an image reflected from the outer surface of the effective region of the panel and an image reflected from its inner surface. Concerning the distortion of reflected image, since the intensity of the light rays reflected from the inner surface is weak, it is regarded enough to consider only the reflected image formed by the light rays reflected from the outer surface. In the cathode-ray tube whose outer surface is a curved surface, since the reflected image on the outer surface is distorted, it is recognized that the flatness of the image is deteriorated. To lessen the distortion of the reflected image on the outer surface, the radius of curvature of the outer surface must be increased, and by forming a flat plane, deterioration of visual recognition of flatness can be eliminated.

On the other hand, the distortion of image occurring on the fluorescent screen is caused by refraction of light rays in the effective region of the panel, and changes depending on the viewpoint of viewing the image displayed on the fluorescent screen. If the viewpoint is fixed, a curved surface not causing distortion due to refraction can be formed. Generally, however, the viewpoint is not fixed, and in particular when viewing the image from the viewpoint remote from the tube axis to right or left, that is, from an oblique direction, the problem of distortion is not solved by a curved surface symmetrical to the tube axis.

Figure 2:
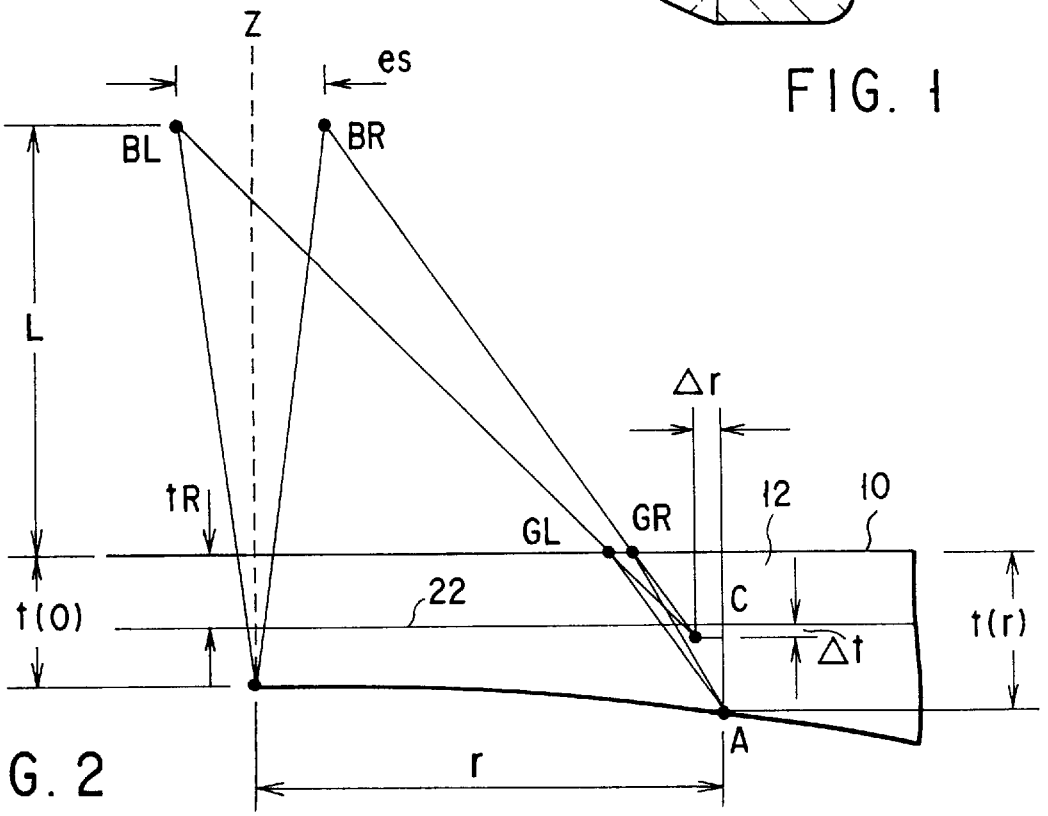
FIG. 2 is a diagram for explaining distortion of image caused by refraction of light rays in an effective region of a panel.

To explain the distortion of image by refraction, supposing the viewpoint of both eyes set to be in parallel with the tube surface, and the center of both eyes to be on the tube axis, that is, as shown in FIG. 2, when the outer surface of the effective region 10 of the panel 12 is a flat surface and the inner surface is a curved surface having a wall thickness of t(r) at a position of distance r from the center of the panel 12, the fluorescent screen (not shown) emits light at point A on the inner surface at this distance r, and the emitted light rays are observed at viewpoints BL and BR which are set in parallel to a horizontal axis (H axis) on the tube surface, and whose center is located on the tube axis (Z-axis) remote by distance L from the outer surface of the effective region 10 of the panel 12.

In this case, as shown in FIG. 2, the light rays emitted from a light spot A pass through the panel 12 and are directed to the viewpoints BL and BR. Here, since the light rays are refracted by the outer surface of the panel 12, they pass intersection points GL and GR and are directed to the viewpoints EL and BR. Therefore, from the viewpoints BL and BR, the light spot A is shifted upward along the tube axis (lifted), and it appears to be present at point C. In other words, an imaginary point of light spot A is formed at a position C between the inner surface and outer surface of the panel 12.

Assuming a flat reference surface 22 positioned at the inner side by distance tR along the tube axis Z from the outer surface of the effective region 10, the distance tR being a distance from the outer surface of the lifted position of the center of the inner surface of the panel, the visual recognition of flatness on this reference surface 22 may be considered as follows.

On the reference surface 22, the imaginary point C is visible deviated from the light spot A by deviation amount Δr, and this imaginary point C occurs downward by the portion of the deviation amount Δt along the tube axis direction from the reference surface 22. The deviation amount Δr is defined positive in the direction departing from the center of the panel 12, and the deviation amount Δt is positive in the direction of viewpoints BL and BR. The reference surface 22 is meant to be an imaginary surface, and as the deviation amounts Δr and Δt from the reference surface 22 are Smaller, the distortion due to the refractory by the panel 12 becomes smaller.

Supposing the case where a flat panel having a constant thickness, that is, t(r) 32 t(0), is viewed from the viewpoints, the refractive index of air, na, and the refractive index of the panel, ng, are usually ng≈1.5 and na≈1.0, the diagonal size of the phosphor screen is about 16 to 20 inches, the thickness t(r) of the effective region of the panel is 10 to 12 mm, the distances L from the outer surface of the effective region to the viewpoints are 300 to 600 mm, the interval "es" between both eyes BL, BR is 60 to 70 mm, the deviation amounts Δr and Δt at the diagonal corner, are about 0.5 to 1.0 mm. Further, in order to correct the distortion by the refraction when viewed from the above viewpoints, it suffices if the inner surface of the panel is formed to be substantially a spherical surface having a drop or gap amount of the inner surface at the diagonal corner, with respect to the center of the inner surface of the effective region, of 0.7 mm to 1.0 mm, a drop or gap amount of a V end of 0.1 mm to 0.5 mm, and a drop or gap amount of an H end of 0.5 mm to 0.8 mm. In short, the problem of the distortion of an image due to the refraction by the panel can be dissolved by making the inner surface of the panel to have such a shape as described above.

Generally, however, since the viewpoint tends to be located at a position remote from the tube axis to right or left, on the single spherical surface, the peripheral area appears to be floating and concave. In addition, the strength of the vacuum envelope or shadow mask is lowered, and in the shadow mask, in particular, it is hard to form the effective surface in a desired curved surface.

To solve this problem, it must be considered to suppress the distortion to a minimum limit and increase the wall thickness t(r) in the peripheral area.

As a result of analysis, if the wall thickness t(r) of the peripheral area is increased, in a specific image pattern, although the image pattern is reduced or shifted by refraction, the inner surface shape not changing the shape of the image pattern itself is theoretically deduced, which has led to designing of practical panel shape and shadow mask shape.

It is theoretically explained below.

Figure 3A:
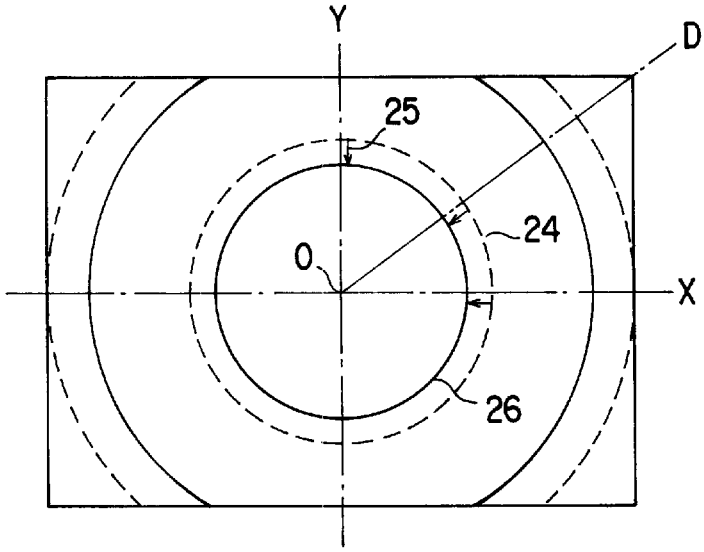
FIG. 3A is a diagram for explaining distortion by refraction of a concentric circular pattern centered on the center of the effective region in the case of the inner surface of the effective region of the panel composed of a single spherical surface.
Figure 3B:
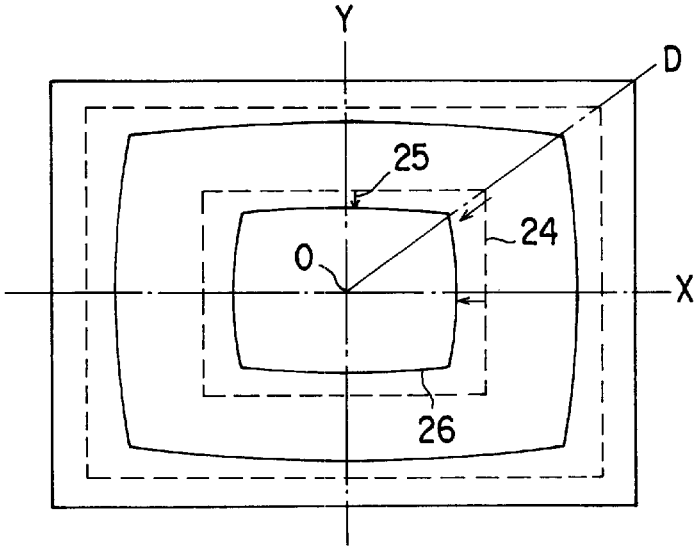
FIG. 3B is a diagram for explaining distortion by refraction of a concentric rectangular pattern centered on the center of the effective region.

In a panel composed of a single spherical surface with the outer surface of the effective region formed in a flat plane, and at the gap on the diagonal ends from the center of the inner surface of 10 to 15 mm, the distortion by refraction as seen from the viewpoint on the tube axis is shown in FIG. 3A and FIG. 3B. FIG. 3A shows a distortion of concentric circular pattern centered on the center O of the effective region, and FIG. 3B shows a distortion of concentric rectangular pattern centered on the center O of the effective region. In FIGS. 3A and 3B, the broken line 24 denotes a distortion-free pattern. The deviation amount Δr due to refraction is in a negative direction (central direction) as indicated by an arrow 25. In the concentric circular pattern centered on the center O of the effective region, at the points on the same circle, since the wall thickness t(r) and viewing angle θ are same, the deviation amount Δr is uniform. Supposing the deviation amount Δr at points on the diagonal axis (D-axis), horizontal axis (H-axis) and vertical axis (V-axis) to be respectively ΔArD, ΔArH, and ΔrV, their relationship is $$\Delta rD=\Delta rH=\Delta rV \tag{18}$$

and the image pattern 26 is reduced as indicated by a solid line, but the pattern shape is not changed. However, in the concentric rectangular pattern centered on the center of the effective region, supposing the distance up to the diagonal point of the pattern 24 indicated by a broken line to be r, the distance from the center of the effective region to the point on the horizontal axis of this pattern 24 is $$\frac{M}{\sqrt{M^2+N^2}}\cdot r \tag{19}$$

and the distance up to the point on the vertical axis is $$\frac{N}{\sqrt{M^2+N^2}}\cdot r \tag{20}$$

and correspondingly, since the wall thickness t(r) is decreased at various points on the diagonal axis, horizontal axis and vertical axis of the pattern 24, their relationship is $$\Delta rD>\Delta rH>\Delta rV \tag{21}$$

and the image pattern 26 is contracted as indicated by a solid line, and is distorted like a barrel.

Figure 4:
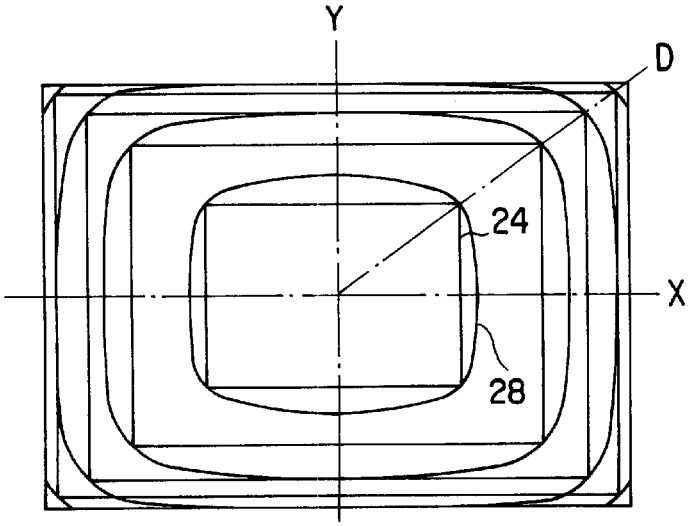
FIG. 4 is an explanatory diagram of a panel adding a spherical portion with a wedge of less than 2 mm at diagonal end to the inner surface shape having a uniform thickness at each point of the rectangular pattern centered on the center of the effective region.
Figure 5A:
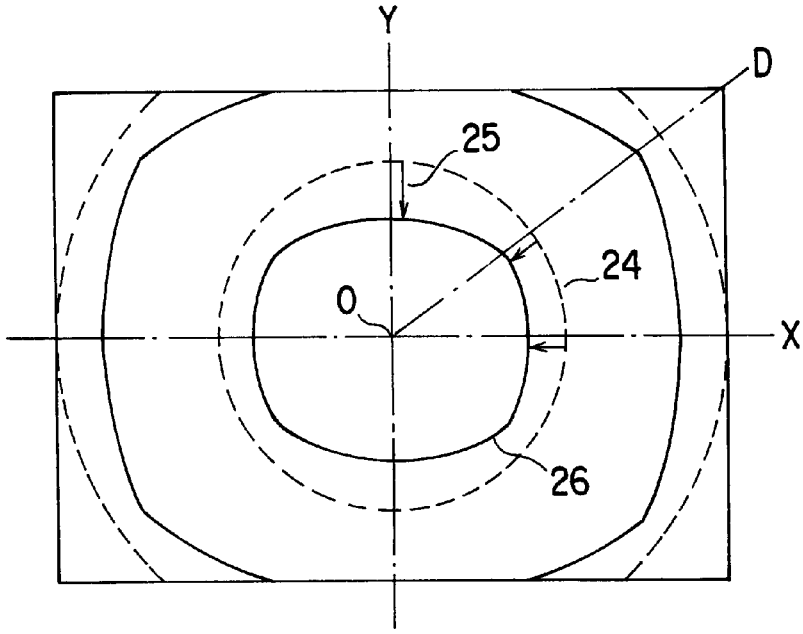
FIG. 5A is a diagram for explaining distortion by refraction of concentric circular pattern centered on the center of the effective region in the panel shown in FIG. 4.
Figure 5B:
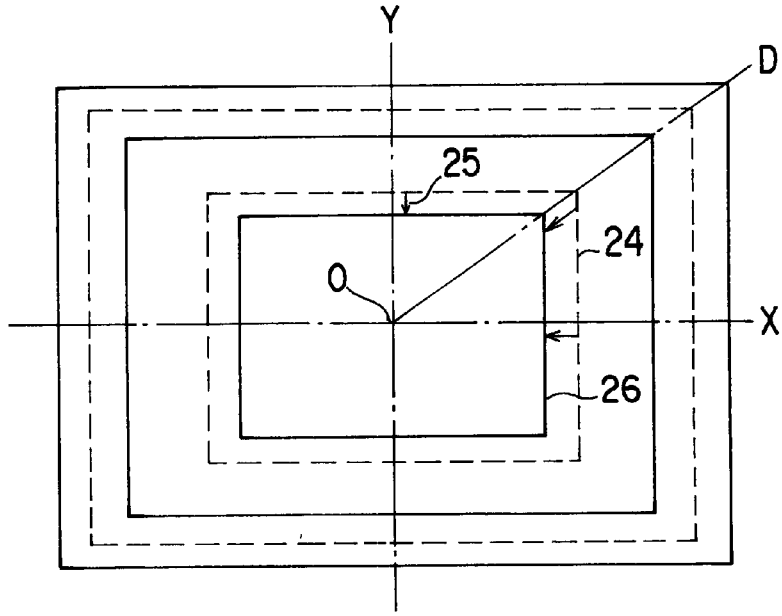
FIG. 5B is a diagram for explaining distortion by refraction of a concentric rectangular pattern centered on the center of the effective region.

Accordingly, when the outer surface of the effective region of the panel is a flat plane, and the inner surface is formed, as shown in FIG. 4, as a curved surface 28 combining a curved surface uniform in the thickness t(r) of each point on a rectangular pattern 24 linking the point on the diagonal axis at distance r from the center of the effective region, the point of formula (19) on the horizontal axis and the point of formula (20) on the vertical axis, with the wall thickness t(r) in the diagonal line increasing in proportion to $r^2$ (a substantially uniform curvature), and a curved surface for suppressing the distortion due to difference in the viewing angle θ at various points on the fluorescent screen as mentioned above (a single spherical surface increasing in thickness of panel, by less than about 2 mm at the diagonal ends), as shown in FIG. 5B, as for the rectangular pattern 24, although the image pattern 26 is contracted by the refraction, but this image pattern 26 is a distortion-free pattern. However, as shown in FIG. 5A, as for the concentric circular pattern 24 centered on the center O of the effective region, since the wall thickness t(r) at various points on the pattern 24 differs depending on the positions, the image pattern 26 is contracted, and is distorted into a pattern having protrusions on the diagonal axis.

In the panel shape as shown in FIG. 4, although the distortion of the rectangular image pattern can be suppressed, the distortion of the concentric circular pattern is obvious. In the actual environment of use, rectangular image patterns are frequently used, but in the screen display or the like, the concentric circular image patterns cannot be ignored. Practically it is preferred to add a spherical portion slightly to the panel shape shown in FIG. 4, and form the inner surface shape of an intermediate shape of the single spherical surface and the curved surface shown in FIG. 4. In particular, in the color cathode ray tube having a shadow mask of molded type, when the shadow mask is formed into a shape similar to the panel shape shown in FIG. 4, flat regions are formed at the horizontal and vertical axis ends, and the strength for holding the curved surface of the shadow mask is lowered. However, by adding the spherical portion, the flatness at the horizontal and vertical axis ends can be alleviated. Therefore, the addition of the spherical component is important also for enhancing the strength for holding the curved surface of the shadow mask.

More specifically, when the rectangular fluorescent screen with an aspect ratio of M:N is formed on the inner surface of the effective region of the panel, where M is the distance in the horizontal direction and N is the distance in the vertical direction, the inner surface may be formed so that the gaps ΔH(r), ΔV(r), ΔD(r) at the points on the horizontal axis, vertical axis and diagonal axis at distance r from he center of the inner surface may satisfy the following formulas 22 and 23.

$$\Delta D(r) > \Delta H\left(\frac{M}{\sqrt{M^2+N^2}}\cdot r\right) > \Delta D\left(\frac{M}{\sqrt{M^2+N^2}}\cdot r\right) \tag{22}$$

$$\Delta D(r) > \Delta V\left(\frac{N}{\sqrt{M^2+N^2}}\cdot r\right) > \Delta D\left(\frac{N}{\sqrt{M^2+N^2}}\cdot r\right) \tag{23}$$

If $$\Delta H\left(\frac{M}{\sqrt{M^2+N^2}}\cdot r\right) = \Delta D(r) \tag{24}$$

and if $$\Delta V\left(\frac{N}{\sqrt{M^2+N^2}}\cdot r\right) = \Delta D(r), \tag{25}$$

not only the distortion of the concentric circular image pattern is increased, but, as for the rectangular image pattern, a pincushion distortion due to viewing angle difference occurs and the peaks on the diagonal axes are in an acute angle, and therefore when the viewpoint is remote from the tube axis, peaks are easily recognized visually, which is not preferred. Still more, since the horizontal and vertical axis end portions are extremely flat, in the color cathode ray tube, the strength for holding the curved surface of the shadow mask is lowered, and it is hence difficult practically.

As compared with the panel having such inner surface shape, in the panel whose inner surface is formed of a single spherical surface, the relationship is $$\Delta D(r)=\Delta H(r)=\Delta V(r) \tag{26}$$

Therefore, as mentioned above, the distortion of the rectangular image pattern is increased.

That is, the inner surface shape of the effective region of the panel is formed in a curved surface as defined in the formulas 22 and 23, and the gap ΔD(r Max) at the diagonal axis end (r=r Max) is defined within 5 mm to 20 mm, thereby realizing a panel excellent in visual recognition of flatness, s compared with other curved surface whose gap at the diagonal axis end is same as the gaps at the horizontal axis end and vertical axis end.

Concerning the relationship between the distance r in the diagonal axis direction from the center of the effective region of the panel and the wall thickness t(r), considering that the viewpoint is often apart from the tube axis to right or left, a substantially uniform curvature may be defined so that t(r) increases in proportion to $r^2$.

When the inner surface shape of the effective region of the panel is formed as such curved surface, it is preferred for designing of the shadow mask. That is, when the inner surface of the effective region is formed as a curved surface defined by the formulas 22 and 23, if the gap ΔD(r Max) at the diagonal axis end is the same, the gaps ΔH(r Max) and ΔV(r Max) at the horizontal axis end and vertical axis end may be set larger than those of the panel composed of a single spherical surface. Accordingly, the curvature may be set larger in the horizontal axis and vertical axis direction of the effective surface of the shadow mask formed in a shape corresponding to the inner surface shape of the effective region, thereby allowing to alleviate the elongation and tensile strength necessary for forming the effective surface of the shadow mask, and thermal deformation of the effective surface caused by collision of electron beam.

Practical examples of the curved surface shape of the inner surface of the effective region of the panel and the effective surface of the shadow mask applied in the color cathode ray tube with diagonal size of 18 inches are explained below while referring to embodiments.

(Embodiments)

Figure 6:
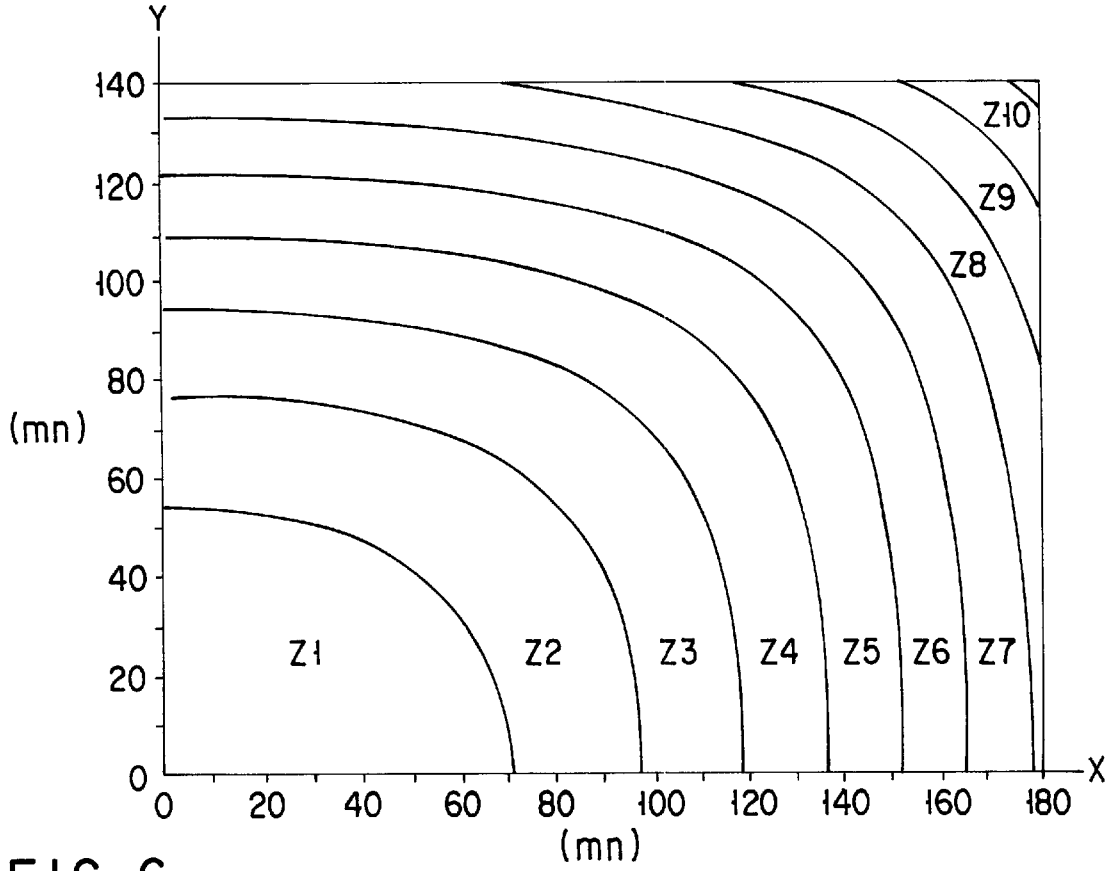
FIG. 6 is a contour line diagram showing the gap of parts from the center of the inner surface of the effective region of a panel of a color cathode ray tube of 18 inches in the diagonal size.
Figure 7:
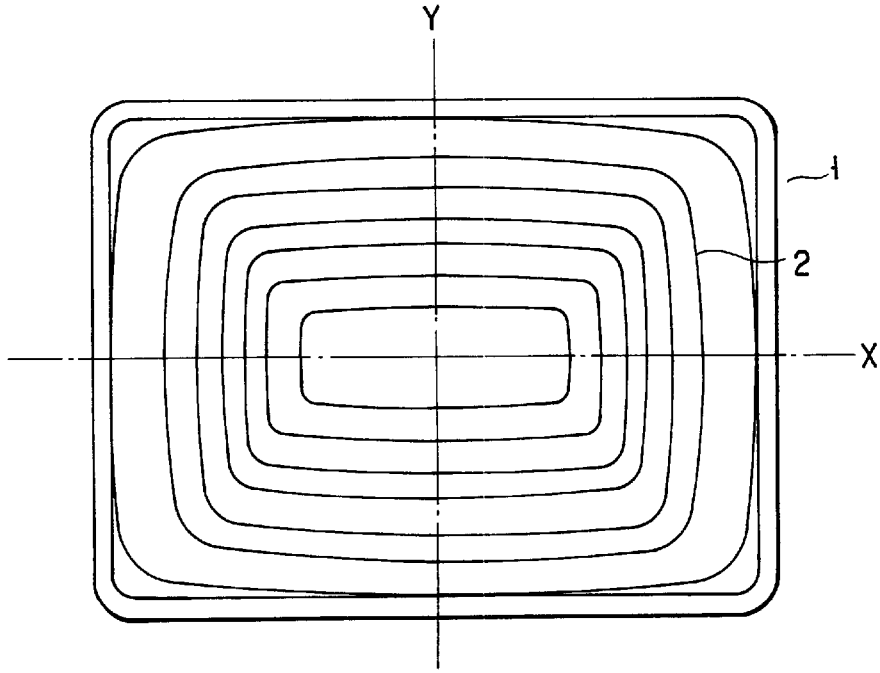
FIG. 7 is a diagram showing the shape of a conventional improved panel.

FIG. 6 is a contour line diagram showing the gaps of parts from the center of the inner surface of the effective region of the panel of the color cathode ray tube in the diagonal size of 18 inches, and Table 1 shows the gaps of regions z1 to z10 indicated by the contour lines. Moreover, Tables 2-1 and 2-2 show the gaps of parts by horizontal and vertical coordinates, Tables 3-1 and 3-2 show the radius of curvature Rx in the horizontal direction of the parts, and Tables 4-1 and 4-2 show the radius of curvature Ry in the vertical direction.

TABLE 1

| Region | Gap |
|---|---|
| z1 | 0 to 1 |
| z2 | 1 to 2 |
| z3 | 2 to 3 |
| z4 | 3 to 4 |
| z5 | 4 to 5 |
| z6 | 5 to 6 |
| z7 | 6 to 7 |
| z8 | 7 to 8 |
| z9 | 8 to 9 |
| z10 | 9 to 10 |

TABLE 2-1

| | | X coordinate (mm) | | | | | | | | | |
|---|---|---|---|---|---|---|---|---|---|---|---|
| | | 0 | 10 | 20 | 30 | 40 | 50 | 60 | 70 | 80 | 90 |
| Y coordinate (mm) | 0 | 0.00 | −0.02 | −0.08 | −0.19 | −0.34 | −0.53 | −0.76 | −1.04 | −1.36 | −1.73 |
| | 10 | −0.03 | −0.05 | −0.12 | −0.22 | −0.37 | −0.56 | −0.79 | −1.06 | −1.38 | −1.75 |
| | 20 | −0.13 | −0.15 | −0.21 | −0.32 | −0.46 | −0.64 | −0.87 | −1.14 | −1.45 | −1.80 |
| | 30 | −0.30 | −0.32 | −0.38 | −0.47 | −0.61 | −0.78 | −1.00 | −1.26 | −1.56 | −1.90 |
| | 40 | −0.54 | −0.55 | −0.61 | −0.70 | −0.82 | −0.99 | −1.19 | −1.43 | −1.71 | −2.04 |
| | 50 | −0.84 | −0.85 | −0.90 | −0.98 | −1.10 | −1.25 | −1.43 | −1.66 | −1.92 | −2.23 |
| | 60 | −1.21 | −1.22 | −1.26 | −1.34 | −1.44 | −1.57 | −1.74 | −1.94 | −1.18 | −2.47 |
| | 70 | −1.65 | −1.66 | −1.69 | −1.76 | −1.85 | −1.96 | −2.11 | −2.29 | −2.51 | −2.77 |
| | 80 | −2.15 | −2.16 | −2.19 | −2.25 | −2.32 | −2.42 | −2.55 | −2.71 | −2.91 | −3.14 |
| | 90 | −2.73 | −2.74 | −2.76 | −2.81 | −2.87 | −2.96 | −3.07 | −3.21 | −3.38 | −3.59 |
| | 100 | −3.38 | −3.38 | −3.41 | −3.44 | −3.50 | −3.57 | −3.67 | −3.79 | −3.95 | −4.13 |
| | 110 | −4.09 | −4.10 | −4.12 | −4.15 | −4.20 | −4.27 | −4.36 | −4.47 | −4.61 | −4.78 |
| | 120 | −4.88 | −4.89 | −4.91 | −4.94 | −4.99 | −5.06 | −5.14 | −5.25 | −5.38 | −5.54 |
| | 130 | −5.75 | −5.75 | −5.78 | −5.81 | −5.87 | −5.94 | −6.03 | −6.14 | −6.27 | −6.44 |
| | 140 | −6.68 | −6.69 | −6.72 | −6.77 | −6.83 | −6.92 | −7.03 | −7.15 | −7.30 | −7.48 |

20

TABLE 2-2

| | | X coordinate (mm) | | | | | | | | |
|---|---|---|---|---|---|---|---|---|---|---|
| | | 100 | 110 | 120 | 130 | 140 | 150 | 160 | 170 | 180 |
| Y coordinate (mm) | 0 | −2.14 | −2.60 | −3.10 | −3.65 | −4.25 | −4.90 | −5.60 | −6.36 | −7.16 |
| | 10 | −2.15 | −2.61 | −3.10 | −3.66 | −4.26 | −4.91 | −5.61 | −6.36 | −7.17 |
| | 20 | −2.20 | −2.65 | −3.15 | −3.69 | −4.29 | −4.93 | −5.63 | −6.39 | −7.21 |
| | 30 | −2.29 | −2.72 | −3.21 | −3.74 | −4.33 | −4.97 | −5.67 | −6.44 | −7.26 |
| | 40 | −2.41 | −2.83 | −3.30 | −3.82 | −4.40 | −5.04 | −5.74 | −6.50 | −7.34 |
| | 50 | −2.58 | −2.98 | −3.43 | −3.93 | −4.50 | −5.13 | −5.83 | −6.60 | −7.45 |
| | 60 | −2.80 | −3.17 | −3.60 | −4.09 | −4.64 | −5.26 | −5.95 | −6.72 | −7.68 |
| | 70 | −3.07 | −3.42 | −3.83 | −4.30 | −4.83 | −5.43 | −6.12 | −6.89 | −7.76 |
| | 80 | −3.42 | −3.74 | −4.12 | −4.57 | −5.08 | −5.66 | −6.33 | −7.10 | −7.96 |
| | 90 | −3.84 | −4.14 | −4.50 | −4.91 | −5.40 | −5.96 | −6.62 | −7.36 | −8.22 |
| | 100 | −4.36 | −4.64 | −4.97 | −5.36 | −5.82 | −6.35 | −6.97 | −7.69 | −8.52 |
| | 110 | −4.99 | −5.24 | −5.55 | −5.91 | −6.34 | −6.84 | −7.42 | −8.10 | −8.88 |
| | 120 | −5.74 | −5.98 | −6.26 | −6.59 | −6.99 | −7.44 | −7.98 | −8.59 | −9.30 |
| | 130 | −6.63 | −6.85 | −7.12 | −7.43 | −7.78 | −8.19 | −8.66 | −9.19 | −9.79 |
| | 140 | −7.68 | −7.90 | −8.15 | −8.44 | −8.75 | −9.19 | −9.48 | −9.90 | −10.36 |

TABLE 3-1

| | | X coordinate (mm) | | | | | | | | | |
|---|---|---|---|---|---|---|---|---|---|---|---|
| | | 0 | 10 | 20 | 30 | 40 | 50 | 60 | 70 | 80 | 90 |
| Y coordinate (mm) | 0 | 2374 | 2372 | 2366 | 2355 | 2341 | 2322 | 2300 | 2275 | 2246 | 2215 |
| | 10 | 2399 | 2397 | 2389 | 2377 | 2360 | 2339 | 2313 | 2283 | 2250 | 2214 |
| | 20 | 2476 | 2473 | 2462 | 2444 | 2419 | 2388 | 2351 | 2310 | 2263 | 2213 |
| | 30 | 2615 | 2606 | 2589 | 2560 | 2522 | 2473 | 2417 | 2354 | 2285 | 2212 |
| | 40 | 2818 | 2809 | 2781 | 2735 | 2673 | 2598 | 2512 | 2418 | 2317 | 2213 |
| | 50 | 3114 | 3098 | 3053 | 2980 | 2883 | 2768 | 2639 | 2502 | 2360 | 2218 |
| | 60 | 3526 | 3501 | 3427 | 3312 | 3168 | 2990 | 2803 | 2609 | 2418 | 2232 |
| | 70 | 4092 | 4051 | 3934 | 3752 | 3525 | 3270 | 3005 | 2742 | 2491 | 2257 |
| | 80 | 4855 | 4789 | 4602 | 4321 | 3981 | 3615 | 3249 | 2903 | 2585 | 2300 |
| | 90 | 5836 | 5733 | 5442 | 5019 | 4526 | 4019 | 3535 | 3094 | 2706 | 2369 |
| | 100 | 6951 | 6799 | 6381 | 5787 | 5121 | 4460 | 3853 | 3319 | 2861 | 2475 |
| | 110 | 7859 | 7672 | 7159 | 6442 | 5650 | 4878 | 4181 | 3576 | 3065 | 2638 |
| | 120 | 7961 | 7792 | 7327 | 6663 | 5913 | 5166 | 4475 | 3864 | 3339 | 2893 |
| | 130 | 6968 | 6874 | 6607 | 6204 | 5717 | 5193 | 4670 | 4173 | 3717 | 3307 |
| | 140 | 5381 | 5359 | 5294 | 5190 | 5050 | 4882 | 4691 | 4483 | 4265 | 4043 |

TABLE 3-2

| | | X coordinate (mm) | | | | | | | | |
|---|---|---|---|---|---|---|---|---|---|---|
| | | 100 | 110 | 120 | 130 | 140 | 150 | 160 | 170 | 180 |
| Y coordinate (mm) | 0 | 2180 | 2144 | 2105 | 2065 | 2023 | 1981 | 1937 | 1893 | 1884 |
| | 10 | 2175 | 2133 | 2090 | 2044 | 1997 | 1950 | 1901 | 1853 | 1804 |
| | 20 | 2159 | 2103 | 2045 | 1985 | 1925 | 1864 | 1803 | 1743 | 1684 |
| | 30 | 2135 | 2057 | 1978 | 1898 | 1820 | 1742 | 1667 | 1594 | 1524 |
| | 40 | 2107 | 2002 | 1898 | 1797 | 1699 | 1606 | 1518 | 1434 | 1355 |
| | 50 | 2079 | 1944 | 1815 | 1693 | 1579 | 1473 | 1375 | 1284 | 1201 |
| | 60 | 2055 | 1890 | 1738 | 1599 | 1471 | 1356 | 1252 | 1151 | 1072 |
| | 70 | 2045 | 1849 | 1676 | 1521 | 1383 | 1261 | 1153 | 1058 | 973 |
| | 80 | 2048 | 1827 | 1634 | 1466 | 1321 | 1194 | 1083 | 986 | 902 |
| | 90 | 2080 | 1833 | 1622 | 1442 | 1289 | 1157 | 1044 | 946 | 861 |
| | 100 | 2151 | 1879 | 1651 | 1459 | 1297 | 1159 | 1041 | 940 | 853 |
| | 110 | 2283 | 1988 | 1741 | 1535 | 1361 | 1214 | 1089 | 982 | 890 |
| | 120 | 2517 | 2207 | 1936 | 1712 | 1523 | 1361 | 1223 | 1104 | 1002 |
| | 130 | 2945 | 2627 | 2349 | 2108 | 1897 | 1714 | 1554 | 1414 | 1291 |
| | 140 | 3820 | 3601 | 3389 | 3185 | 2990 | 2806 | 2634 | 2472 | 2321 |

TABLE 4-1

| | | X coordinate (mm) | | | | | | | | | |
|---|---|---|---|---|---|---|---|---|---|---|---|
| | | 0 | 10 | 20 | 30 | 40 | 50 | 60 | 70 | 80 | 90 |
| Y coordinate (mm) | 0 | 1497 | 1507 | 1537 | 1590 | 1667 | 1774 | 1918 | 2109 | 2360 | 2691 |
| | 10 | 1496 | 1506 | 1535 | 1586 | 1662 | 1766 | 1905 | 2089 | 2329 | 2644 |
| | 20 | 1493 | 1502 | 1530 | 1577 | 1646 | 1741 | 1867 | 2031 | 2242 | 2513 |
| | 30 | 1489 | 1497 | 1521 | 1552 | 1621 | 1701 | 1807 | 1941 | 2110 | 2321 |
| | 40 | 1483 | 1499 | 1508 | 1541 | 1587 | 1649 | 1728 | 1827 | 1949 | 2097 |
| | 50 | 1476 | 1480 | 1493 | 1514 | 1545 | 1586 | 1637 | 1700 | 1766 | 1866 |
| | 60 | 1467 | 1458 | 1474 | 1483 | 1515 | 1538 | 1567 | 1602 | 1644 | 1696 |
| | 70 | 1456 | 1455 | 1453 | 1449 | 1444 | 1439 | 1436 | 1434 | 1436 | 1442 |
| | 80 | 1444 | 1440 | 1429 | 1411 | 1388 | 1361 | 1334 | 1307 | 1283 | 1264 |
| | 90 | 1431 | 1424 | 1403 | 1370 | 1329 | 1283 | 1234 | 1188 | 1145 | 1109 |
| | 100 | 1416 | 1406 | 1375 | 1328 | 1269 | 1205 | 1140 | 1078 | 1023 | 975 |
| | 110 | 1401 | 1386 | 1345 | 1284 | 1210 | 1130 | 1052 | 979 | 915 | 862 |
| | 120 | 1384 | 1366 | 1315 | 1239 | 1151 | 1058 | 970 | 891 | 822 | 765 |
| | 130 | 1367 | 1345 | 1283 | 1195 | 1093 | 991 | 895 | 811 | 740 | 683 |
| | 140 | 1322 | 1251 | 1150 | 1038 | 927 | 827 | 741 | 670 | 613 | 569 |

TABLE 4-2

| | | X coordinate (mm) | | | | | | | | |
|---|---|---|---|---|---|---|---|---|---|---|
| | | 100 | 110 | 120 | 130 | 140 | 150 | 160 | 170 | 180 |
| Y coordinate (mm) | 0 | 3128 | 3701 | 4437 | 5326 | 6242 | 6863 | 6780 | 5917 | 4674 |
| | 10 | 3056 | 3591 | 4269 | 5077 | 5905 | 6479 | 6448 | 5718 | 4600 |
| | 20 | 2859 | 3296 | 3833 | 4453 | 5082 | 5547 | 5623 | 5193 | 4392 |
| | 30 | 2582 | 2900 | 3275 | 3697 | 4124 | 4475 | 4634 | 4504 | 4083 |
| | 40 | 2274 | 2482 | 3721 | 2986 | 3263 | 3522 | 3719 | 3798 | 3718 |
| | 50 | 1971 | 2094 | 2235 | 2395 | 2573 | 2765 | 2966 | 3162 | 3335 |
| | 60 | 1696 | 1759 | 1835 | 1928 | 2044 | 2190 | 2377 | 2624 | 2961 |
| | 70 | 1456 | 1479 | 1515 | 1568 | 1645 | 1758 | 1926 | 2185 | 2616 |
| | 80 | 1252 | 1250 | 1261 | 1290 | 1343 | 1433 | 1580 | 1832 | 2305 |
| | 90 | 1081 | 1064 | 1061 | 1075 | 1112 | 1185 | 1314 | 1549 | 2032 |
| | 100 | 938 | 913 | 901 | 906 | 934 | 993 | 1106 | 1321 | 1795 |
| | 110 | 820 | 790 | 773 | 773 | 794 | 843 | 942 | 1137 | 1590 |
| | 120 | 721 | 689 | 670 | 667 | 682 | 724 | 811 | 987 | 1414 |
| | 130 | 638 | 606 | 587 | 581 | 593 | 629 | 705 | 864 | 1263 |
| | 140 | 569 | 537 | 518 | 512 | 521 | 552 | 619 | 762 | 1132 |

The values in FIG. 6, and Tables 2-1, 2-2, 3-1 and 3-2 are given in the formula of supposing the gap or drop from the center of the inner surface of the effective region to be Z, where i and j are integers 0 to 2, and a is the coefficient shown in Table 5.

$$Z=\Sigma A_{i,j}\cdot Y^{2i}\cdot X^{2j} \tag{27}$$

TABLE 5

| $A_{1,j}$ | Value |
|---|---|
| $A_{0,0}$ | 0 |
| $A_{0,1}$ | 0.000211 |
| $A_{0,2}$ | $3.23 \times 10^{-10}$ |
| $A_{1,0}$ | 0.000334 |
| $A_{1,1}$ | $-2.21 \times 10^{-10}$ |
| $A_{1,2}$ | $4.65 \times 10^{-13}$ |
| $A_{2,0}$ | $3.58 \times 10^{-10}$ |
| $A_{2,1}$ | $8.19 \times 10^{-10}$ |
| $A_{2,2}$ | $-2.29 \times 10^{-17}$ |

The radii of curvature Rx, Ry in the horizontal and vertical directions are determined from the following formulas:

$$Rx = \left\{1 + \left(\frac{\partial}{\partial x} z\right)^2\right\}^{3/2} \Big/ \left(\frac{\partial^2}{\partial x^2} z\right) \tag{28}$$

$$Ry = \left\{1 + \left(\frac{\partial}{\partial y} z\right)^2\right\}^{3/2} \Big/ \left(\frac{\partial^2}{\partial y^2} z\right) \tag{29}$$

When the inner surface shape of the effective region is thus determined, as shown in Table 2, the gaps ZD (r=228 mm), ZH (r=180 mm), and ZV (r=140 mm) at the diagonal axis end, horizontal axis end, and vertical axis end corresponding to the deviation values ΔD(r Max), ΔH(r Max), and ΔV(r Max) are respectively about 10.4 mm, 7.2 mm, and 6.7 mm.

When the inner surface shape of the effective region is thus determined, the effective surface of the shadow mask determined corresponding to the inner surface shape may include a sufficient elongation in the horizontal and vertical directions when forming. Moreover, by setting the radius of curvature in either one of the horizontal and vertical directions smaller, about 2000 mm, it is possible to alleviate the tensile strength or thermal deformation due to collision of electron beams.

The foregoing embodiments relate to the color cathode ray tube, but the invention may be also applied in other cathode-ray tubes than the color cathode ray tube.

INDUSTRIAL APPLICABILITY

Thus, by forming the outer surface of the panel in a flat surface and defining the gaps from the center of the inner surface, the strength of the vacuum envelope is maintained, and the visual recognition of the flatness of the image displayed on the fluorescent screen formed on its inner surface may be improved. Furthermore, in the color cathode ray tube, the workability of the shadow mask can be enhanced, and lowering of strength can be avoided.

What is claimed is:

1. A cathode-ray tube having a panel whose outer surface is a flat surface and whose inner surface is a convex curved surface projecting in the outward direction from its center, and forming a substantially rectangular fluorescent screen on the inner surface of this panel, with an aspect ratio of M:N where M is the distance in the horizontal direction and N is the distance in the vertical direction, wherein the inner surface of the panel is formed in a curved surface satisfying the following formulas $$\Delta D(r) > \Delta H\left(\frac{M}{\sqrt{M^2+N^2}} \cdot r\right) > \Delta D\left(\frac{M}{\sqrt{M^2+N^2}} \cdot r\right) \tag{1}$$

$$\Delta D(r) > \Delta V\left(\frac{N}{\sqrt{M^2+N^2}} \cdot r\right) > \Delta D\left(\frac{N}{\sqrt{M^2+N^2}} \cdot r\right) \tag{2}$$

where ΔH(r), ΔV(r), ΔD(r) are respectively differences along a tube axis on the horizontal axis, vertical axis and diagonal axis of the fluorescent screen at positions of distance r from the center of the inner surface.

2. A cathode-ray tube according to claim 1, wherein when the difference ΔD(r) on the diagonal axis of the fluorescent screen of the panel is the maximum difference ΔD(r Max) along a tube axis, this maximum difference ΔD(r Max) is determined in a range of 5 mm to 20 mm.

3. A cathode-ray tube having a panel whose outer surface is a flat surface and whose inner surface is a convex curved surface projecting in the outward direction from its center, forming a substantially rectangular fluorescent screen composed of fluorescent layers of plural colors on the inner surface of this panel, with an aspect ratio of M:N where M is the distance in the horizontal direction and N is the distance in the vertical direction, and disposing a substantially rectangular color selecting electrode oppositely to this fluorescent screen, having a convex curved surface projecting in the direction of the panel from its center, with an aspect ratio of this convex curved surface of M:N where M is the distance in the horizontal direction and N is the distance in the vertical direction, for selecting plural beams emitted from an electron gun by this color selecting electrode and displaying a color image on the fluorescent screen, wherein the convex curved surface of the color selecting electrode is formed in a curved surface satisfying the following formulas $$\Delta DM(r) > \Delta HM\left(\frac{M}{\sqrt{M^2+N^2}} \cdot r\right) > \Delta DM\left(\frac{M}{\sqrt{M^2+N^2}} \cdot r\right) \tag{3}$$

$$\Delta DM(r) > \Delta VM\left(\frac{N}{\sqrt{M^2+N^2}} \cdot r\right) > \Delta DM\left(\frac{N}{\sqrt{M^2+N^2}} \cdot r\right) \tag{4}$$

where ΔHM(r), ΔVM(r), ΔDM(r) are respectively differences along a tube axis on the horizontal axis, vertical axis and diagonal axis of the color selecting electrode at positions of distance r from the center of the convex curved surface.

4. A cathode-ray tube according to claim 3, wherein when the difference ΔDM(r) on the diagonal axis of the color selecting electrode is the maximum difference ΔDM(r Max), this maximum difference ΔDM(r Max) is determined in a range of 5 mm to 20 mm.

* * * * *